US009541078B2

(12) United States Patent
Bonucci et al.

(10) Patent No.: US 9,541,078 B2
(45) Date of Patent: Jan. 10, 2017

(54) GETTER PUMP

(71) Applicant: SAES GETTERS S.P.A., Lainate (MI) (IT)

(72) Inventors: Antonio Bonucci, Hamburg (DE); Paolo Manini, Milan (IT); Andrea Conte, Milan (IT); Luca Viale, Cavenago di Brianza (IT)

(73) Assignee: SAES GETTERS S.P.A., Lainate (MI) (IT)

( * ) Notice: Subject to any disclaimer, the term of this patent is extended or adjusted under 35 U.S.C. 154(b) by 0 days.

(21) Appl. No.: 14/786,138

(22) PCT Filed: Mar. 25, 2015

(86) PCT No.: PCT/IB2015/052174

§ 371 (c)(1),
(2) Date: Oct. 21, 2015

(87) PCT Pub. No.: WO2015/150974

PCT Pub. Date: Oct. 8, 2015

(65) Prior Publication Data

US 2016/0069337 A1 Mar. 10, 2016

(30) Foreign Application Priority Data

Apr. 3, 2014 (IT) ..... MI2014A0595

(51) Int. Cl.
*F04B 37/02* (2006.01)
*F04B 37/14* (2006.01)
(Continued)

(52) U.S. Cl.
CPC ..... *F04B 37/02* (2013.01); *F04B 37/14* (2013.01); *H01J 7/18* (2013.01); *H01J 7/183* (2013.01); *H01J 41/20* (2013.01)

(58) Field of Classification Search
CPC ..... F04B 37/02; F04B 37/14; H01J 7/18; H01J 7/183; H01J 41/20
(Continued)

(56) References Cited

U.S. PATENT DOCUMENTS 3,662,522 A 5/1972 Della Porta et al.
4,137,012 A * 1/1979 della Porta ..... H01J 7/18 376/146

(Continued)

FOREIGN PATENT DOCUMENTS

EP 0742370 11/1996
EP 0753663 1/1997

(Continued)

OTHER PUBLICATIONS

International Search Report mailed on Jun. 23, 2015 for PCT/IB2015/052174 filed on Mar. 25, 2015 in the name of SAES Getters S.P.A.

(Continued)

*Primary Examiner* — Charles Freay
(74) *Attorney, Agent, or Firm* — Steinfl & Bruno, LLP

(57) ABSTRACT

A getter pump is described. The getter pump has a casing and a getter cartridge mounted within the casing. Each cartridge has a linear central support and spaced getter elements mounted on the linear central support. Each cartridge is positioned along a plane orthogonal to the revolution axis and intersecting the midpoint of a linear central support. The angle formed by each positioning plane with its respective linear central support is comprised between 35° and 75°.

17 Claims, 3 Drawing Sheets

(51) Int. Cl.
*H01J 7/18* (2006.01)
*H01J 41/20* (2006.01)

(58) Field of Classification Search
USPC ..... 417/48, 51
See application file for complete search history.

(56) References Cited

U.S. PATENT DOCUMENTS

| | | | | | |
|---|---|---|---|---|---|
| 5,772,404 | A * | 6/1998 | Carella | F04B 37/02 | 417/313 |
| 6,109,880 | A * | 8/2000 | Krueger | C23C 14/564 | 417/48 |
| 6,149,392 | A * | 11/2000 | Conte | H01J 7/18 | 417/51 |
| 6,299,746 | B1 * | 10/2001 | Conte | C23C 14/564 | 118/715 |
| 2004/0201349 | A1 | 10/2004 | Ramamoorthi et al. | | |

FOREIGN PATENT DOCUMENTS

| | | | |
|---|---|---|---|
| JP | 2013-165293 | * | 8/2013 |
| WO | 94/02957 | | 2/1994 |
| WO | 98/58173 | | 12/1998 |
| WO | 2009/118398 | | 10/2009 |
| WO | 2010/105944 | | 9/2010 |
| WO | 2014/060879 | | 4/2014 |

OTHER PUBLICATIONS

Written Opinion mailed on Jun. 23, 2015 for PCT/IB2015/052174 filed on Mar. 25, 2015 in the name of SAES Getters S.P.A.

* cited by examiner

GETTER PUMP

CROSS REFERENCE TO RELATED APPLICATIONS

The present application is the US national stage of International Patent Application PCT/IB2015/052174 filed internationally on Mar. 25, 2015, which, in turn, claims priority to Italian Patent Application No. MI2014A000595 filed on Apr. 3, 2014.

The present invention relates to an improved getter pump comprising a plurality of getter cartridges.

Getter pumps, used alone or in combination with other types of pumps, are widely used and appreciated, and are described in various documents such as the international patent applications WO 9858173, WO 2010/105944 and WO 2009/118398 in the applicant's name.

Even though the combination of getter pumps with other types of vacuum pumps provides distinct advantages in certain applications, such as surface science systems and analyzers operating under vacuum, the use of stand-alone getter pumps is preferred when there are constraints that do not allow for such combined use, in particular when active gases such as $H_2$, CO, $CO_2$ are the main gas source and pumping of noble gases is not an issue.

A particular type of getter pump using a plurality of disks of getter material mounted on a central support is described in EP 0742370 and EP 0753663 both in the applicant's name, while a pump containing a plurality of such elements is described in U.S. Pat. No. 6,149,392 in the applicant's name, whose teachings and content are herein incorporated by reference.

In U.S. Pat. No. 6,149,392 it is recognized that for some applications is it more important and crucial to have a high gas sorption velocity rather than a high gas sorption capacity, a typical example being the case of particle accelerators where there are a plurality of vacuum pumps installed in different sections of the accelerator to provide an adequate vacuum level throughout the whole length.

The inventors have further investigated this problem and have found an alternate and different configuration capable of further improving the pumping speed as described in the international application number PCT/IB2013/058802, still unpublished, in the applicant's name.

In further developing and studying the problem of alternate geometries and cartridge arrangements of a getter pump, the inventors have found a different solution that in specific situations provides advantages with respect to the configurations described in the aforementioned application PCT/IB2013/058802. In particular, the present invention is a getter pump comprising a casing, whose shape is a solid of revolution with a revolution axis, and a plurality of getter cartridges mounted within said getter pump casing, each cartridge comprising a linear central support and spaced getter elements mounted on said linear central support. A plane orthogonal to the revolution axis and intersecting the midpoint of a linear central support is defined a getter cartridge "positioning plane", and the pump is characterized in that the angles formed by said positioning planes with the linear central supports are comprised between 35° and 75°, preferably between 40° and 70°.

The expression "solid of revolution" is intended to comprise all those solid figures obtained by revolving a plane area about a given axis that lies in the same plane, also defined as "revolution axis". In its common and most useful embodiment for the present invention the solid of revolution is a truncated cone, while other useful shapes are cones or cylinders or combinations thereof. Moreover for the purposes of the present invention, taking into account that the solid of revolution is an ideal shape and that the pump casing is instead a real object, minor deviations from the ideal geometrical revolution shape are still within its breadth and scope.

The invention will be further illustrated with the help of the following figures, where:

Figure 1:
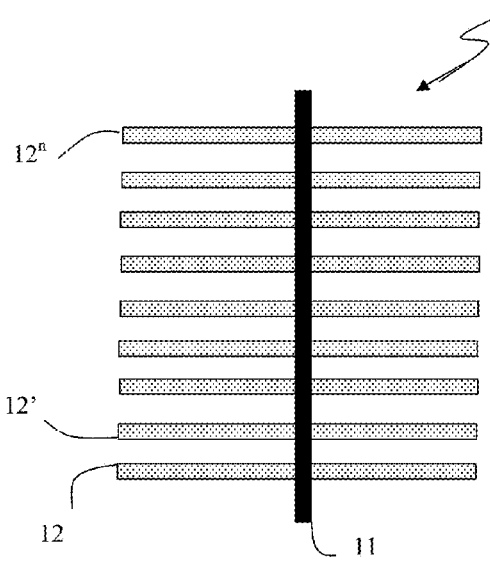
FIG. 1 shows a schematic representation of a getter cartridge according to the prior art and herein used as constituting element in the getter pump according to the present invention.

In the figures, the dimensions and dimensional ratios of the elements may not be correct and in some cases, such as for example in FIG. 1 the diameters of the spaced getter elements in the form of disks with respect to the central shaft diameter, have been altered in order to improve the figure comprehensibility.

The getter pump according to the present invention envisions the presence of a plurality of getter cartridges, such as the one schematically represented in FIG. 1, each getter cartridge 10 having a central shaft 11 acting as support and a plurality of spaced getter elements 12, 12', . . . 12'', typically and most preferably having the shape of disks. In FIG. 1 the means fixing the getter disks to the central shaft have not been shown since they are not necessary for the comprehension of the invention and within the knowledge of a person skilled in the art.

Figure 1A:
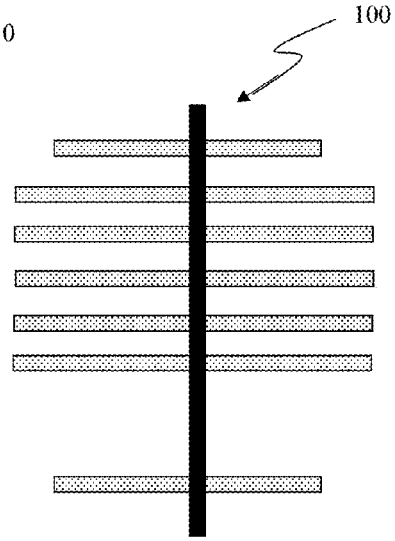
FIG. 1A shows a schematic representation of a variation of a getter cartridge according to the prior art.

As shown in FIG. 1A, an alternative getter cartridge 100 suitable to be used in getter pumps according to the present invention may have getter disks that are not equally spaced but there may be some gaps/voids at the extremities or within the disk stack and/or it may have some disks, typically the uppermost and lowermost ones, having a reduced diameter and/or an eccentric arrangement to facilitate the getter cartridge insertion/connection.

Those spaces are useful in case there are encumbrances to be taken into account given by the cartridges themselves or other elements, such as for example, power supply cables or feed-troughs.

Therefore a getter cartridge having the plurality of getter elements essentially equally spaced is just a preferred and non-limiting example of a suitable getter cartridge to be used in the pumps according to the present invention.

The features and characteristics of the getter cartridges will not be described in greater detail since this knowledge is in possession of a person skilled in the art, in any case some details and information are present in the already mentioned EP 0742370 and EP 0753663. In the present invention it is necessary for the shaft 11 acting as support of the getter elements to be linear, such as shown in FIG. 1, in EP 0742370, in EP 0753663 and in U.S. Pat. No. 6,149,392, while a configuration such as the one shown in WO 9858173 would not be suitable. The most useful shape for the linear shaft/support is cylindrical. Also, additional elements that may in some cases be present, such as additional thermal shields, are encompassed by the present invention.

It should also be noted that the invention is not limited to a specific getter material, but any suitable material capable to sorb gases by means of a thermal treatment may be employed and falls within the definition of getter materials for the scope and purposes of the present invention. The knowledge and characteristics of such materials are available to a person skilled in the art and may be easily retrieved from various sources, such as, for example, the above mentioned EP 0742370. Particularly advantageous are getter metals or alloys comprising at least 30% of one or more of titanium, zirconium, yttrium.

The inventors, in trying to further improve the speed of a getter pump using a plurality of getter cartridges, have found specific configurations that provide improvements with respect to the ones described in U.S. Pat. No. 6,149,392.

Figure 2:
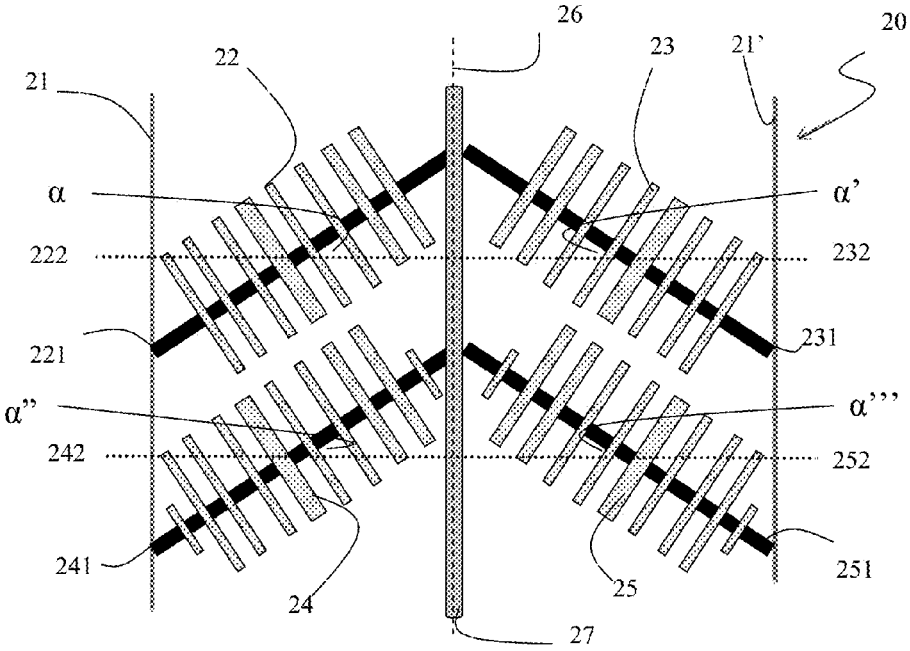
FIG. 2 shows a cross-sectional view of an embodiment of a getter pump according to the present invention.

In particular, FIG. 2 shows a longitudinal cross-sectional view of a portion of a getter pump according to the present invention. The getter pump portion 20 has a cylindrical casing defined by two side walls 21 and 21', and its geometry is further defined by a revolution axis 26. Within the casing are contained four getter cartridges 22, 23, 24, 25, each with its own positioning plane 222, 232, 242, 252 orthogonal to the revolution axis 26 and intersecting the midpoint of the cartridge linear supports 221, 231, 241, 251. The angles formed by each positioning plane 222, 232, 242, 252 with each getter cartridge linear support 221, 231, 241, 251, are respectively indicated with $\alpha$, $\alpha'$, $\alpha''$ and $\alpha'''$. For getter pumps according to the present invention it is necessary that those angles are all comprised between 35° and 75°, preferably such angles are all comprised between 40° and 70°. In the embodiment schematically represented in FIG. 2 all the cartridges 22, 23, 24, 25 are connected to the casing walls 21, 21' and to a central vertical element 27, preferably coaxial with the revolution axis 26, that provides mechanical support and could be used also to establish a voltage difference with the casing walls 21, 21' to enable the passage of current in the linear cartridge supports 221, 231, 241, 251 for their heating during regeneration.

The embodiment shown in FIG. 2 has two type of cartridges, 22 and 23 have disks of equal diameter while 24 and 25 have the disks closer to the side walls 21, 21' of the casing and to the connecting central vertical element 27 of reduced diameter and/or eccentrically arranged, in order to allow a better exploitation of the available space. This is just for exemplification of a suitable alternative, as in general it is more convenient, albeit not mandatory, that all the getter cartridges are equal to each other.

It is to be underlined that in the embodiment shown in FIG. 2 all the angles are equal to each other, but also in this case this is just one of the most convenient embodiments and said condition is not mandatory, i.e. one or more of the angles $\alpha$, $\alpha'$, $\alpha''$ and $\alpha'''$ even if fulfilling the main limitation of being comprised between 35° and 75° may be different in value from the other ones. Moreover, all the cartridges 22, 23, 24 and 25 are connected to a same central element 27, but in the most general case they may be connected to different inner supporting elements.

In FIG. 2 the means connecting the getter cartridges to the casing and to the central element have not been shown since they are conventional and widely known to a person skilled in the art, such as for example soldering. In this regard it is important to underline that the terminal parts of the linear central support may possibly be bent to ease its fixing onto the casing and the central element, whereby the central support must be linear at least in the portion holding the getter disks.

Figure 3A:
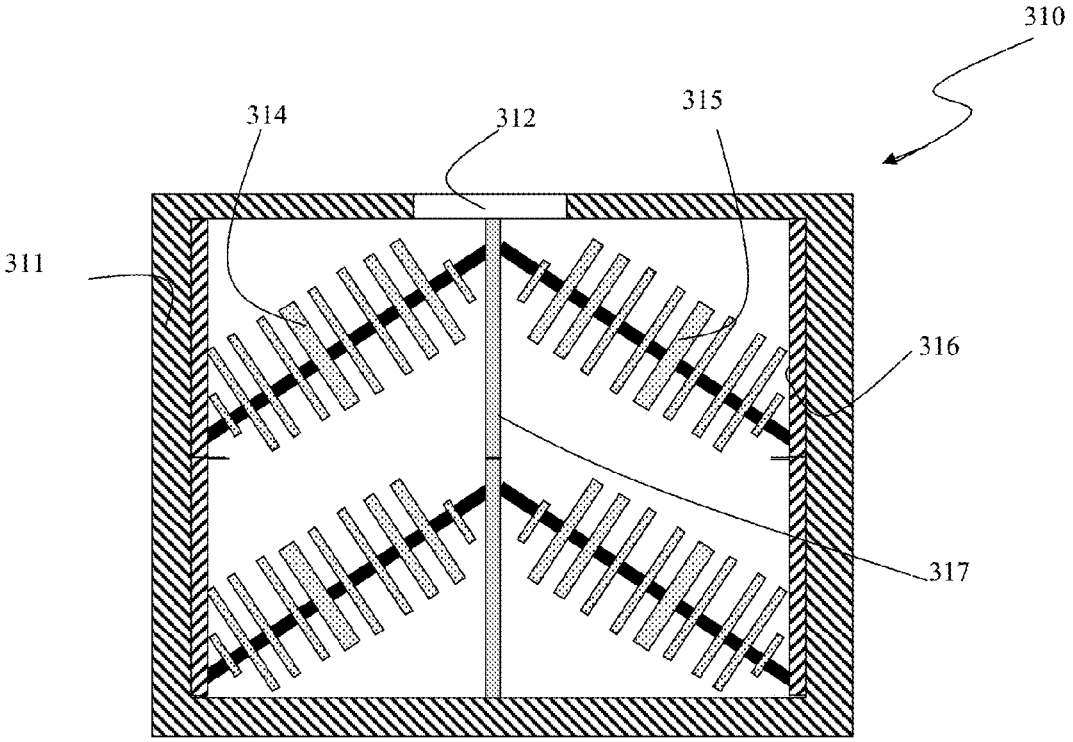
FIGS. 3A and 3B show cross-sectional views of alternative and similar to each other embodiments of a getter pump according to the present invention.
Figure 3B:
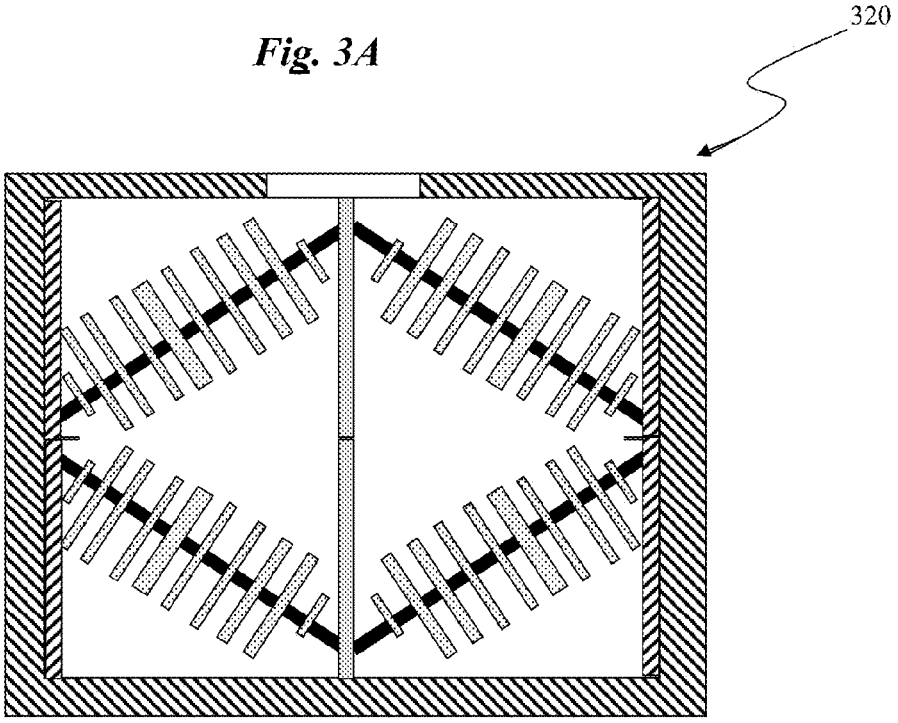

The getter pump according to the present invention may be made by means of subassemblies integrated into a casing having the shape of a solid of revolution. This solution is outlined in the cross-sectional views of FIGS. 3A and 3B. In FIG. 3A getter pump 310 has a casing 311 with an opening 312, containing an upper subassembly made up of two getter cartridges 314, 315 contained in a subcasing 316 acting as outer support for the getter cartridges which are also attached to an inner support 317. The outer support 316 may be attached and restrained to casing 311 by geometrical constraints only. In FIG. 3A two identical subassemblies are stacked with the same orientation, while pump 320 in FIG. 3B shows an alternative arrangement with the second subassembly turned upside down. In FIGS. 3A and 3B elements having the same graphical representation and meaning have not been further described.

It is to be underlined that the embodiments shown in FIGS. 3A and 3B are non-limiting examples on how to integrate more getter cartridge subassemblies into a getter pump according to the present invention.

With regards to the getter cartridges suitable to be used in the getter pump structure according to the present invention, these have a linear central support whose length is preferably comprised between 4 and 30 cm, holding preferably between 2 and 7 getter disks per cm in the disk-holding portion.

The number of getter cartridges placed in each pump may be usefully comprised between 2 and 100, more preferably between 4 and 25.

Moreover additional elements external to the getter pump such as a power supply and control elements have not been shown since they are conventional. Their purpose is typically to supply current to the linear central supports of the getter cartridges so that the getter disks are reactivated by heating the supports. With regards to heating, this may be alternatively provided by external sources that heat the casing of the getter pump, such sources possibly being already present in the system where the getter pump is installed, since the system often envisions the presence of baking systems that in some cases may advantageously be used also to heat up and activate the getter pump, or more in general by any other suitable means to heat in a controlled way the getter cartridges.

With regards to the casing, there are two preferred embodiments. In the first one the casing is closed at one end by a metallic base, usually made with the same material of the side wall, and at the other end by a standard vacuum flange; in this configuration the preferred embodiment envisions the presence of an inner connecting element, preferably placed in the center (i.e. coaxial with the revolution axis).

In a second preferred embodiment the casing is defined only by the side wall, in this configuration the getter pump has an open-ended casing so that gas molecules can travel across the getter pump. This configuration is useful when the pump may be directly integrated in systems, for example coaxially, rather than being an additional element, as for example in the case of wall sections of particle accelerators that may be substituted with getter pumps according to the present invention, with a casing made according to the second preferred embodiment. This getter pump configuration allows the distribution of large sorption velocity and capacity inside the main section of a particle accelerator without interfering with any particle or electron beam moving through it.

In this case the most preferred casing geometry is the truncated cone, with the getter cartridges following the cone inclination, i.e. the linear supporting element of the getter cartridge is parallel to the truncated cone walls. This embodiment of getter pump 40 is shown in the schematic cross-sectional view of FIG. 4. Getter cartridges 42 and 43 are disposed with their linear supports 421, 431 lying parallel to the side walls 41, 41'. The casing has two openings, 44 and 45 for the gas flow and a revolution axis 46. Also in this case angles β, β' formed by positioning planes 422, 432 with the getter cartridge linear supports 421, 431 are comprised between 35° and 75°. This specific embodiment has the advantage of ensuing a better (quicker and more efficient) heating of the getter cartridge by the heat shielding action of the adjacent casing walls.

Figure 4:
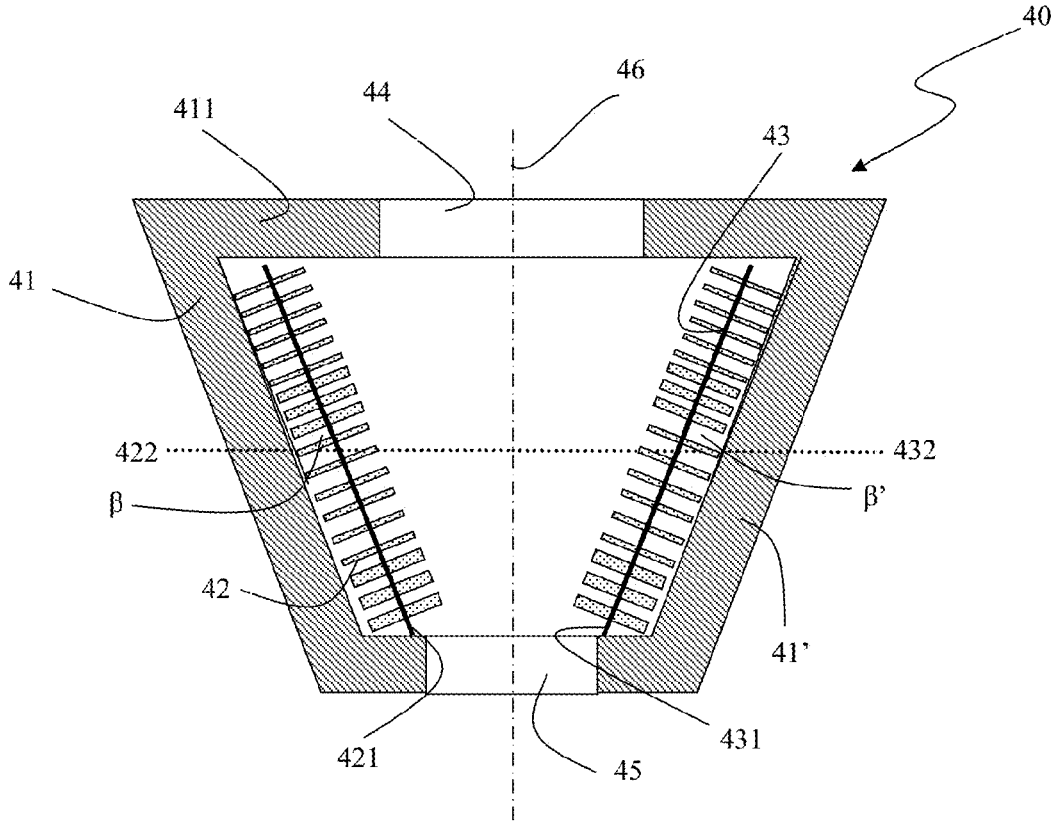
FIG. 4 shows a cross-sectional view of another alternative embodiment of a getter pump according to the present invention.

The angles formed by the getter positioning planes with the linear central supports of the cartridges are always intended as the acute angle formed by these two elements, as also represented in FIG. 2 (α, α', α", α'") and FIG. 4 (β, β').

Even though the getter pumps according to the present invention are most suitably used as stand-alone pumps, they can also be used in pumping systems coupled with other types of vacuum pumps, such as for example turbomolecular pumps, sputter ion pumps (SIP), cryopumps or other NEG (Non-Evaporable Getter) pumps.

The invention claimed is:

1. A getter-pump, comprising:

a getter pump casing shaped as a revolution solid with a revolution axis; and a plurality of getter cartridges mounted within said getter pump casing, each getter cartridge comprising a linear central support and spaced getter elements mounted on said linear central support, each getter cartridge being positioned along a getter cartridge positioning plane orthogonal to the revolution axis and intersecting the midpoint of a linear central support, wherein for each getter cartridge, the angle formed by said positioning plane with the linear central support is between 35° and 75°.

2. The getter pump according to claim 1, wherein said revolution solid is a truncated cone.

3. The getter pump according to claim 2, wherein each said linear central support is parallel to walls of the casing.

4. The getter pump according to claim 1, wherein, for each getter cartridge, at least a first end of the linear central support is in contact with the casing.

5. The getter pump according to claim 4, wherein a second end of the linear central support of at least one getter cartridge is in contact with a supporting element.

6. The getter pump according to claim 1, wherein each cartridge has a first end connected to a first supporting element and a second end connected to a second supporting element.

7. The getter pump according to claim 5, wherein said first supporting element is coaxial with the revolution axis.

8. The getter pump according to claim 1, wherein for each getter cartridge, said linear central support has a length between 4 and 30 cm.

9. The getter pump according to claim 1, wherein said casing is closed at one end by a base and at the opposite end by a flange.

10. The getter pump according to claim 1, wherein the number of getter cartridges is between 4 and 25.

11. The getter pump according to claim 1, wherein said casing is open-ended.

12. The getter pump according to claim 1, wherein the number of getter cartridges is between 2 and 100.

13. The getter pump according to claim 1, wherein at least one angle for one getter cartridge is different from one or more other angles for other getter cartridges.

14. A pumping system comprising vacuum pumps coupled to the getter pump according to claim 1.

15. The pumping system according to claim 14, wherein the vacuum pumps are selected from the group consisting of sputter ion pumps, turbomolecular pumps, cryogenic pumps, and NEG pumps.

16. The getter pump according to claim 1, wherein for each getter cartridge, the angle formed by said positioning plane with the linear central support is between 40° and 70°.

17. The getter pump according to claim 8, wherein said linear central support carries between 2 and 7 getter elements per cm.

* * * * *